US009272757B2

(12) United States Patent
Ibsen et al.

(10) Patent No.: US 9,272,757 B2
(45) Date of Patent: Mar. 1, 2016

(54) EVACUATION SYSTEM

(75) Inventors: Christian Ibsen, Tønder (DK); Søren Kristiansen, Esbjerg V (DK); Jens Nielsen, Arre (DK); Sinne Nielsen, Kolding (DK); Knud Søndertoft Pedersen, Vejle (DK)

(73) Assignee: Viking Life-Saving Equipment A/S, Esbjerg (DK)

( * ) Notice: Subject to any disclaimer, the term of this patent is extended or adjusted under 35 U.S.C. 154(b) by 114 days.

(21) Appl. No.: 14/127,132

(22) PCT Filed: Jun. 15, 2012

(86) PCT No.: PCT/EP2012/061511

§ 371 (c)(1),
(2), (4) Date: May 19, 2014

(87) PCT Pub. No.: WO2012/172083

PCT Pub. Date: Dec. 20, 2012

(65) Prior Publication Data

US 2014/0283729 A1 Sep. 25, 2014

(30) Foreign Application Priority Data

Jun. 17, 2011 (DK) ..... 2011 70312

(51) Int. Cl.
*B63B 23/40* (2006.01)
*B63C 9/02* (2006.01)
*B63C 9/22* (2006.01)

(52) U.S. Cl.
CPC . *B63B 23/40* (2013.01); *B63C 9/02* (2013.01); *B63C 9/22* (2013.01)

(58) Field of Classification Search
CPC ..... B63C 9/02; B63B 23/40
USPC ..... 114/365–366
See application file for complete search history.

(56) References Cited

U.S. PATENT DOCUMENTS 1,133,700 A * 3/1915 Basile ..... B63B 23/04 114/366
1,810,564 A * 6/1931 Kelemen ..... B63B 23/32 114/365

(Continued)

FOREIGN PATENT DOCUMENTS

EP 2058221 A2 5/2009
GB 2261416 A 5/1993

(Continued)

OTHER PUBLICATIONS

International Searching Authority, International Search Report and Written Opinion issued in corresponding International Application No. PCT/EP2012/061511 dated Nov. 15, 2012, 11 pages.

*Primary Examiner* — Lars A Olson
*Assistant Examiner* — Jovon Hayes
(74) *Attorney, Agent, or Firm* — Wood, Herron & Evans, LLP

(57) ABSTRACT

The present invention relates to an evacuation system (4) for a vessel (1) or offshore facility, comprising a storage unit (7) having a length, a width and a height defining a volume of the storage unit (7), the storage unit (7) in a storage situation being adapted to house one or more self-propelling, inflatable floatable units (5), the inflatable floatable units each having a capacity of more than 150 persons, and a deployment arrangement (8) having a displacement device, wherein a maximum height of the storage unit is 2.7 meters, and the displacement device is adapted to displace the one or more self-propelling, inflatable floatable units in a substantially horizontal and linear direction out of the storage unit (7) below the maximum height and subsequently lower the one or more self-propelling, inflatable floatable units (5) into the water in a substantially vertical direction.

47 Claims, 14 Drawing Sheets

(56) References Cited

U.S. PATENT DOCUMENTS 2,091,327 A * 8/1937 McPartland ..... B63B 23/32 114/366
4,516,944 A * 5/1985 Hirobumi ..... B63C 9/04 114/345
4,522,144 A * 6/1985 Klem ..... B63B 23/28 114/348
4,633,802 A * 1/1987 Olsen ..... B63C 9/22 114/367
4,660,677 A * 4/1987 Hunter ..... B63B 23/32 114/366
4,781,144 A * 11/1988 O'Brien ..... B63B 23/32 114/365
5,331,913 A * 7/1994 Tanaka ..... B63B 23/26 114/259
5,341,761 A * 8/1994 O'Brien ..... B63B 23/04 114/365
5,342,230 A * 8/1994 Louis ..... B63C 9/22 114/366
5,706,755 A * 1/1998 O'Brien ..... B63B 27/10 114/365
5,765,500 A * 6/1998 Nordb.o slashed. ..... A62B 1/20 114/365
6,138,605 A * 10/2000 O'Brien ..... B63B 23/34 114/365
6,672,242 B2 * 1/2004 Webb ..... B63B 23/62 114/365
6,869,326 B2 * 3/2005 Richard ..... B65D 21/0223 441/42
7,438,016 B2 * 10/2008 Dronne ..... B63C 9/22 114/365
7,681,515 B1 * 3/2010 Apple ..... B63C 9/22 114/365
9,021,976 B2 * 5/2015 Michaud ..... B63C 9/22 114/366
2007/0006790 A1 * 1/2007 Dronne ..... B63C 9/22 114/365
2013/0008367 A1 * 1/2013 Michaud ..... B63C 9/22 114/365
2014/0283729 A1 * 9/2014 Ibsen ..... B63C 9/22 114/366

FOREIGN PATENT DOCUMENTS

GB 2338219 A 12/1999
WO 00/29283 A1 5/2000
WO WO 0029283 A1 * 5/2000
WO 00/32464 A1 6/2000

* cited by examiner 5
22
51
50
22

5
22
22
51
50
22
1
2
3

EVACUATION SYSTEM

FIELD OF THE INVENTION

The present invention relates to an evacuation system for a vessel or offshore facility, comprising a storage unit having a length, a width and a height defining a volume of the storage unit, the storage unit in a storage situation being adapted to house one or more self-propelling, inflatable floatable units, the inflatable floatable units each having a capacity of more than 150 persons, and a deployment arrangement having a displacement device.

BACKGROUND ART

In the case of ships or vessels having many crew members and passengers on board, safety regulations require that the ship or vessel is equipped with evacuation systems with the capacity to handle a higher number of persons than the actual number of persons on board the ship or vessel.

This is for instance achieved by equipping the vessel with a combination of a plurality of tender boats having a capacity of up to 150 persons, a plurality of lifeboats also having a capacity of up to 150 persons, and a plurality of inflatable life rafts, for instance having a capacity of 35 persons. The number of the various equipment types depends on the number of passengers on board the ship or vessel.

In FIG. 1*a*, a typical Panamax cruise vessel 1 is shown. The cruise vessel 1 has a length overall (LOA) of 294.0 meters, a width (B) of 32.2 meters and a draught (d) of 8.8 meters. The cruise vessel 1 may have 2672 passengers and 925 crew members on board, in total 3597 persons. Regulations demand that the cruise vessel 1 has evacuation capacity for 4497 persons on board.

In the cruise vessel 1, this is obtained by 6 tender boats 2 of 150 persons providing an evacuation capacity of 900 persons, 12 lifeboats 3 of 150 persons providing an evacuation capacity of 1800 persons and 52 life rafts (not shown) of 35 persons providing an evacuation capacity of 1820 persons, resulting in a total evacuation capacity of 4520 persons.

As shown in FIG. 1, 5 lifeboats 3 occupy the length L1 on the one side, and 5 other lifeboats on the opposite side of the cruise vessel 1 occupy the same length.

Since the tender boats 2 and lifeboats 3 having a capacity of 150 persons each have a considerable size, they occupy much room on the cruise vessel and often on the deck of the cruise vessel, as well as in the height of the vessel.

Furthermore, since the tender boats and lifeboats have a considerable size and thereby weight, the cruise ship or vessel has to be reinforced in the areas where the boats are positioned on the vessel. In addition, due to the sizes and weight of the boats, their deployment also requires large deployment arrangements.

Moreover, the persons to be evacuated in tender boats and lifeboats enter the tender boats and lifeboats when these are on board the ship or vessel, and the tender boats and lifeboats are subsequently lowered (with the persons on board) into the water. During the lowering, the tender boats and lifeboats may experience sudden movements and may also slam into the side of the vessel, which is very unpleasant for the persons in the tender boats and lifeboats. In the worst-case scenario, they may even be injured.

SUMMARY OF THE INVENTION

It is an object of the present invention to wholly or partly overcome the above disadvantages and drawbacks of the prior art. More specifically, it is an object to provide an improved evacuation system which facilitates evacuation from a vessel in a reliable and safe manner.

Moreover, it is an object to provide an evacuation system having a high evacuation capacity in relation to the persons to be evacuated.

In addition, it is an object to provide an evacuation system which is compact while being stored on board a vessel so that additional space is gained on the vessel.

Furthermore, it is an object to provide an evacuation system which comprises one or more self-propelled units, which may be compared to self-propelled lifeboats.

It is also an object to provide an evacuation system, wherein a deployment arrangement is part of the compact evacuation system.

Additionally, it is an object to provide an evacuation system wherein maintenance and service are facilitated.

The above objects, together with numerous other objects, advantages, and features, which will become evident from the below description, are accomplished by a solution in accordance with the present invention by an evacuation system for a vessel or offshore facility, comprising a storage unit having a length, a width and a height defining a volume of the storage unit, the storage unit in a storage situation being adapted to house one or more self-propelling, inflatable floatable units, the inflatable floatable units each having a capacity of more than 150 persons, and a deployment arrangement having a displacement device, wherein a maximum height of the storage unit is 2.7 meters, and the displacement device is adapted to displace the one or more self-propelling, inflatable floatable units in a substantially horizontal and linear direction out of the storage unit below the maximum height and subsequently lower the one or more self-propelling, inflatable floatable units into the water in a substantially vertical direction.

By the present invention, an evacuation system which is very compact is obtained. The evacuation system has a high evacuation capacity while still being very compact when being stored on board a vessel, meaning that additional space is gained on the vessel. Furthermore, since the deployment arrangement is arranged as part of the storage unit, it is obtained that it does not occupy much space, meaning that a compact evacuation system is obtained which does not exceed 2.7 meters in height.

In an embodiment, the self-propelling, inflatable floatable unit may be positioned on a lifting platform inside the storage unit, the lifting platform being adapted to carry the self-propelling, inflatable floatable unit during deployment.

Furthermore, the deployment arrangement may comprise the displacement device in the form of at least one crane arm pivotally arranged to a crane base; at least one winch connected to a wire; a number of pulleys arranged on the crane arm and the crane base; and an actuator which is adapted to move the crane arm.

Moreover, the wire may be connected to the lifting platform and via the winch adapted to lower the lifting platform as soon as the lifting platform has been substantially linearly and horizontally displaced out of the storage unit.

Also, the crane arm may be a telescopic arm.

In an embodiment, the deployment arrangement may comprise an overhung transverse crane system, the transverse crane system comprising the displacement device, which displacement device is adapted to displace the crane system horizontally and linearly out of the storage unit until the lifting platform is free to be lowered into the water.

Additionally, the displacement device of the overhung transverse crane system may comprise at least two telescopic arms arranged above the lifting platform and below the maximum height of the storage unit.

Moreover, the deployment arrangement may comprise a hydraulic sliding arrangement, the hydraulic sliding arrangement comprising the displacement device, which displacement device is adapted to linearly and horizontally displace the lifting platform out of the storage unit.

In addition, the displacement device of the hydraulic sliding arrangement may comprise at least one sliding arm arranged in the same level as or above the lifting platform.

Also, the lifting platform may have wheels or be guided on rails inside the storage unit.

Furthermore, the storage unit may house one or more escape units.

The volume of the storage unit may correspond to less than 0.2 $m^3$ per person to be evacuated.

Further, the volume may correspond to less than 0.15 $m^3$ per person to be evacuated, preferably less than 0.12 $m^3$, most preferably less than 0.10 $m^3$.

Moreover, the volume of the storage unit may be less than 200 $m^3$, preferably less than 100 $m^3$, more preferably less than 80 $m^3$.

In an embodiment, the storage unit may have a length of 12.2 m, a width of 2.44 m and a height of 2.59 m, corresponding to a 40 feet ISO container.

Additionally, the storage unit may have the same size as an ordinary ISO container of 40 feet, 45 feet or 20 feet.

Furthermore, the self-propelling, inflatable floatable unit may have a capacity of at least 200 persons.

In addition, the evacuation system may have a weight of less than 30,000 kg, preferably less than 25,000 kg.

Also, the storage unit may comprise a power supply.

Moreover, the storage unit may be substantially box-shaped, having a rectangular configuration.

In one embodiment of the invention, the storage unit may comprise one or more doors and/or closable openings.

Furthermore, a side of the storage unit facing the water may be openable to allow rapid deployment of the self-propelling, inflatable floatable units.

Also, the side of the storage unit may be hinged at the top so that it may be swung upwards when opened. The side of the storage unit may be hinged at the bottom or at the sides. Furthermore, the side may also be arranged on rails extending from the storage unit and downwards opposite the vessel side so that the side may slide down the rails when being opened.

Further, the storage unit may be hermetically sealed so that an environment inside the storage unit is not influenced by an outside environment.

Additionally, the storage unit may comprise a climate device adapted to control the environment inside the storage unit.

In an embodiment, the climate device may comprise a humidity control device adapted to control the humidity inside the storage unit.

Moreover, the climate device may be adapted to create a slight overpressure inside the storage unit so as to avoid that outside humidity or moist enters the storage unit if the sealing is lost or if a door is opened.

Also, the storage unit may comprise a monitoring device which is adapted to real time monitor the environment inside the storage unit.

The monitoring device may have a log part storing measurements of the monitored environment so that the measurements may be accessed for evaluation at any time.

Furthermore, a display may be arranged outside the storage unit to facilitate reading of the measurements of the environment inside the storage unit.

In addition, the monitoring device may have a transmitter adapted to send the measurements of the environments to a remotely placed storing device.

Further, the self-propelling, inflatable unit may be contained in one or more shells when stored in the storage unit, the one or more shells substantially completely housing the self-propelling, inflatable floatable unit.

The one or more shells may have a substantially rectangular form.

Also, the self-propelling, inflatable units may be positioned inside the storage unit so that they are accessible, for instance for physical inspection, testing and/or exchanging goods placed within the self-propelling, inflatable floatable unit.

In an embodiment, a plurality of self-propelling, inflatable floatable units may have shells being stored in the storage unit, the shells of each self-propelling, inflatable floatable unit being releasably attached to each other so that during the inflation of the self-propelling, inflatable floatable units they can still be attached to each other to provide a group of self-propelling, inflatable floatable units.

Moreover, the one or more shells may be part of the self-propelling, inflatable floatable unit when inflated.

Additionally, the self-propelling, inflatable floatable unit may comprise four shells, each shell being arranged in a corner portion of the self-propelling, inflatable floatable unit.

In addition, one or more of the shells, preferably all the shells, may comprise propulsion means.

Furthermore, the shell may comprise a first compartment for the propulsion means, in connection with which first compartment a release mechanism is arranged, which during the storage situation secures that the propulsion means is contained in the shell, and which enables the propulsion means to be lowered so that it extends below the shell when the self-propelling, inflatable floatable unit is inflated.

In an embodiment, the propulsion means may have a vertically extendable screw shaft.

In another embodiment, one or more of the shells may comprise a second compartment for a power supply, such as a battery pack.

In addition, the second compartment may be watertight to prevent water from entering the second compartment and flooding the power supply.

Moreover, one or more of the shells may comprise a third compartment for dated goods and items, such as food, medical aid and/or radio.

Further, one or more of the shells may comprise inflating devices, such as nitrogen or carbon dioxide containers.

Also, the inflating devices may be arranged in the second compartment.

Furthermore, one or more of the shells may comprise a secondary inflating device, the secondary inflating device being a compressor.

Moreover, the secondary inflating device may be arranged in the second compartment.

In one embodiment, the one or more shells may comprise wheels.

In addition, a plurality of shells may surround the self-propelling, inflatable floatable unit in the storage situation, the shells being releasably attached to each other.

The shells may be releasably attached by means of a releasable mechanical lock.

Also, the shells may have an outside being opposite a side facing the self-propelling, inflatable floatable unit, and a ladder being arranged on the outside.

Additionally, the shells may be detachably connected to the self-propelling, inflatable floatable unit.

Furthermore, the self-propelling, inflatable floatable unit and the shells may comprise corresponding connection means, the connection means being zips, groove/flange connections, frapping, he/she connections or the like.

Moreover, a plurality of self-propelling, inflatable floatable units having shells may be stored in the storage unit, the shells of each self-propelling, inflatable floatable unit being releasably attached to each other so that during the inflation of the self-propelling, inflatable floatable units, they can still be attached to each other to provide a group of self-propelling, inflatable floatable units.

In addition, the escape unit may comprise one or more chutes and/or slides.

A guidance arrangement may be arranged for guiding and leading persons to be evacuated correctly through the evacuation system.

The storage unit in question may also comprise an inflatable positioning unit adapted to be deployed with the self-propelling, inflatable floatable units.

Furthermore, the lifting platform, after deployment of the self-propelling, inflatable floatable unit, may be adapted to function as ballast for an inflatable position unit.

The present invention furthermore relates to a vessel comprising one or more evacuation systems according to any of the preceding claims. Said vessel may be a passenger ship, a ferry, a cruise ship or a military ship.

Finally, the present invention relates to an offshore facility comprising one or more evacuation systems as described above.

The present invention also relates to an evacuation system for a vessel or offshore facility comprising a storage unit having a volume which in a storage situation is adapted to house one or more self-propelling, inflatable floatable units, the inflatable floatable units each having a capacity of more than 150 persons, deployment arrangement, and one or more escape units, wherein the volume of the storage unit corresponds to less than 0.2 $m^3$ per person to be evacuated.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 2A:
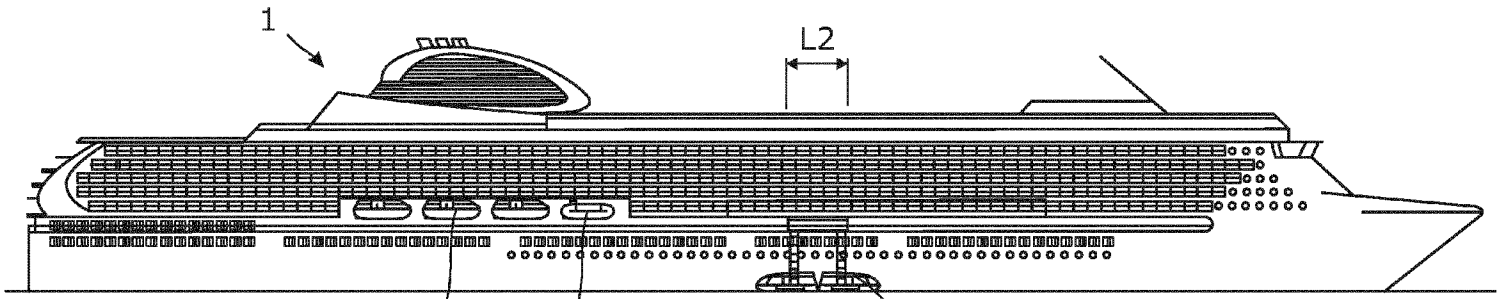
FIG. 2*a* shows the known Panamax cruise vessel having an evacuation system according to the present invention.

FIG. 2*a* shows the known Panamax cruise vessel 1 having an evacuation system 4 according to the present invention. In this embodiment, the required evacuation capacity is obtained by 6 tender boats 2 of 150 persons providing an evacuation capacity of 900 persons, 2 lifeboats 3 of 100 persons providing an evacuation capacity of 200 persons, 52 life rafts (not shown) of 35 persons providing an evacuation capacity of 1820 persons, and 2 evacuation systems 4 according to present invention of 800 persons providing an evacuation capacity of 1600 persons, resulting in a total evacuation capacity of 4520 persons.

Figure 1:
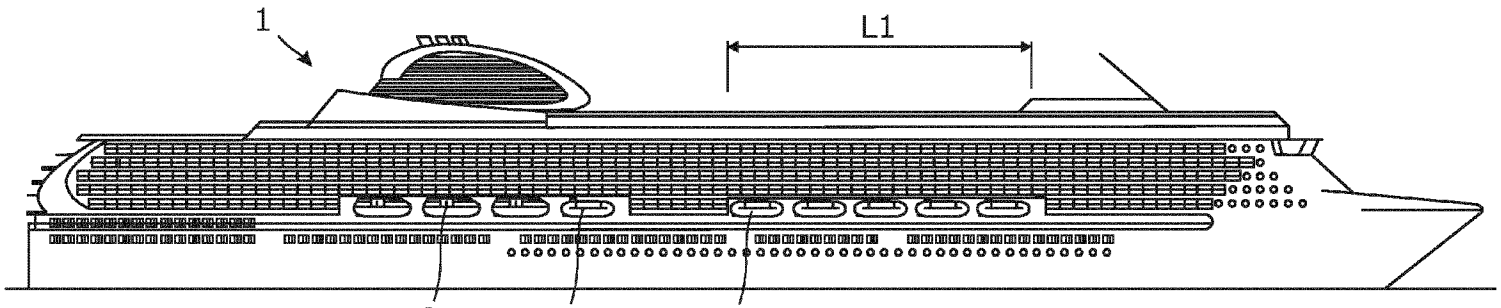
FIG. 1 shows a known Panamax cruise vessel having known evacuation systems in the form of tender boats, lifeboats and inflatable life rafts.

Thus, 2 evacuation systems 4 according to the invention replace 10 lifeboats in comparison to the cruise vessel shown in FIG. 1, still obtaining the required evacuation capacity. Since the evacuation system 4 is a very compact system with a high evacuation capacity, one evacuation system 4 is, in the shown embodiment, arranged to only extend with a length L2 in the length direction of the cruise vessel 1. When comparing the length L1 in FIG. 1 and the length L2 in FIG. 2*a*, it is easily deducible that the evacuation system 4 according to the invention occupies considerably less space in the length direction on the cruise vessel 1. Furthermore, the evacuation system 4 also occupies less space in a height direction of the cruise vessel 1.

Figure 2B:
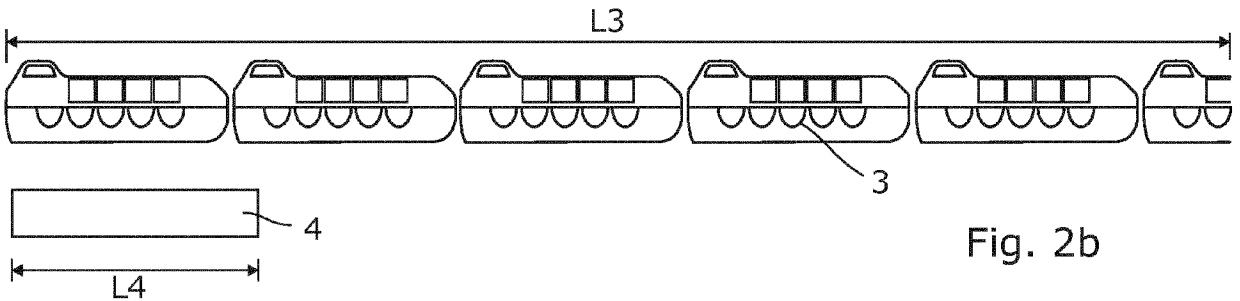
FIG. 2*b* shows a comparison of the space occupied by the known lifeboats in view of the evacuation system according to the present invention.

This means that if the known lifeboats 3 of 150 persons should have an evacuation capacity of 800 persons, it would require 5.3 lifeboats. In FIG. 2*b*, 5.3 lifeboats 3 are shown arranged end to end, occupying a length of L3. As opposed to this, the evacuation system 4 having the same evacuation capacity of 800 persons only occupies a length of L4, which is substantially only one fifth of the length L3 of the 5.3 lifeboats 3, as can easily be observed, since the two systems are shown one above the other. It can also be seen that the lifeboats 3 are higher than the evacuation system 4, which also causes the lifeboats 3 to occupy a greater overall volume on a vessel than does the evacuation system according to the present invention.

In fact, by replacing 10 lifeboats with two evacuation systems according to the invention, as described above, additional space of 720 $m^2$ is gained on the cruise vessel 1. This gained space could be used for additional cabins, e.g. with balconies. This is very advantageous to the ship owners since a cabin with a balcony is of considerably higher value than a cabin without a balcony. Furthermore, the gained space may also provide room for additional ordinary cabins as well as extra public space.

Furthermore, since the evacuation system 4 according to the invention is very compact compared to lifeboats, it also has a lower weight. The example described above of 5.3 lifeboats having a total evacuation capacity of 800 persons normally have a weight of between 60-75 tonnes. On the contrary, the evacuation system 4 having the same evacuation capacity, i.e. 800 persons, only has a weight of 15-35 tonnes. So by installing the evacuation system 4 according to the present invention, the ship owners will not only gain more room for luxury cabins, they will also not need to reinforce the area of the vessel where the evacuation system 4 is positioned, and the evacuation system does not, in the same manner as the lifeboats, add to the overall displacement of the vessel. Furthermore, since the weight of the evacuation system 4 is considerably lower than that of the known evacuation systems, the vessel has a lower energy consumption, which in turn has a positive effect on the environment.

Additionally, the evacuation system 4 according to the invention is reliable, and the evacuation of the persons may be performed in a safe and secure manner.

The evacuation system 4 according to the present invention and its different elements as well as compactness will be further described below.

Figure 3A:
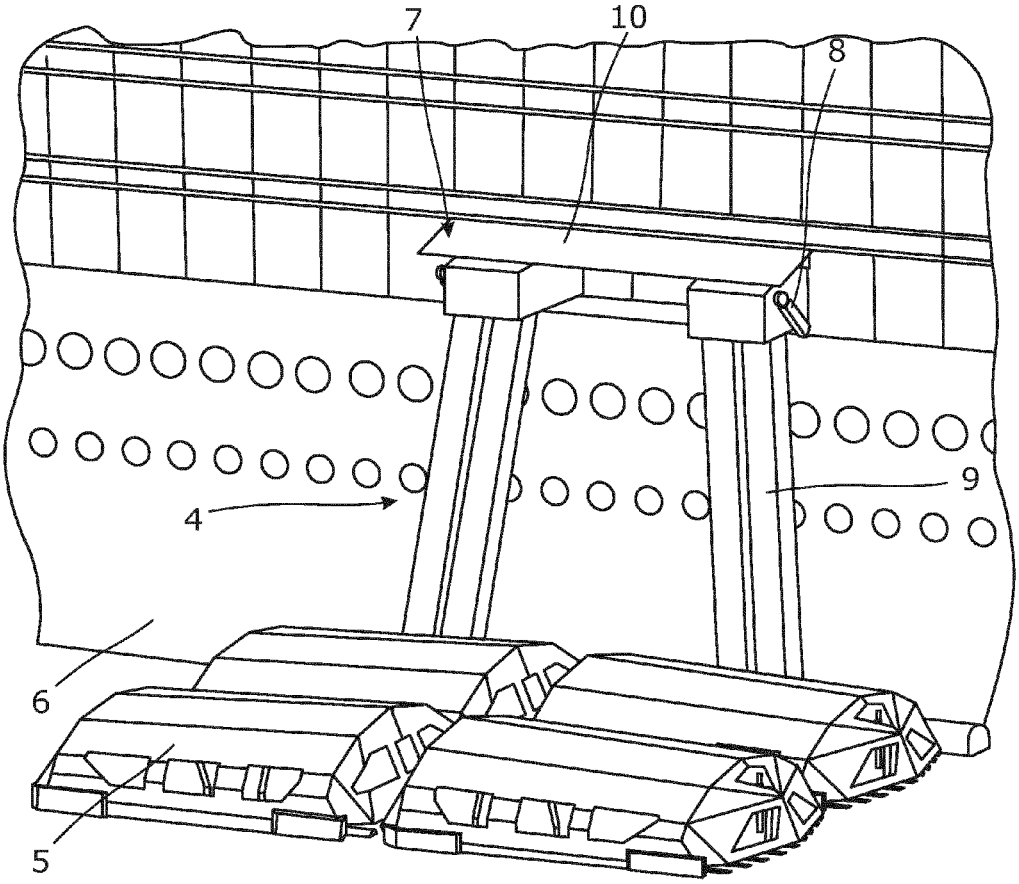
FIG. 3*a* shows an embodiment of the evacuation system fully deployed and positioned along a vessel side.

In FIG. 3*a*, an embodiment of the evacuation system 4 according to the invention is shown with four self-propelling, inflatable floatable units 5 deployed and positioned along a vessel side 6. In this embodiment, the evacuation system 4 comprises a storage unit 7 having a volume which, in a storage situation, is adapted to house the four self-propelling, inflatable floatable units 5, the inflatable floatable units 5, each having a capacity of more than 150 persons. The self-propelling, inflatable floatable units 5 shown in FIG. 3*a* all have a capacity of 200 persons, meaning that the evacuation system 4 shown in FIG. 3*a* has an evacuation capacity of 800 persons.

The storage unit 7 is also adapted to house a deployment arrangement 8 having a displacement device and one or more escape units 9. Each unit will be described in detail below.

Figure 3B:
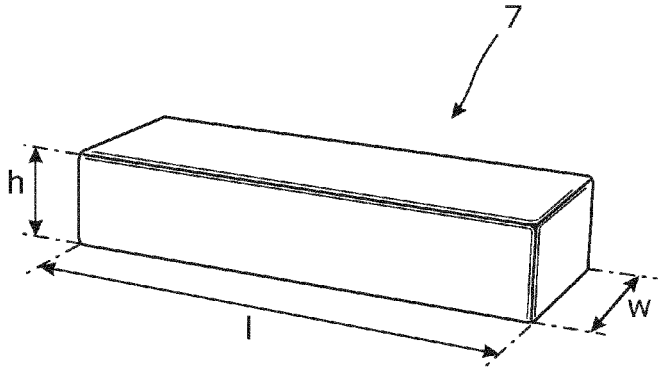
FIG. 3*b* shows a storage unit of the evacuation system.

FIG. 3*b* shows the storage unit 7 of the evacuation system in perspective. In this embodiment, the storage unit 7 has a length l, a width w and a height h defining a volume of the storage unit 7. According to the inventive idea, a maximum height of the storage unit 7 is 2.7 meters.

Advantageously, the storage unit 7 is substantially box-shaped, having a rectangular configuration, as shown in FIG. 3*b*, which facilitates interfacing and positioning of the storage unit 7 on a vessel or offshore facility. The storage unit 7 may have the same size as an ordinary ISO container of 40 feet, 45 feet or 20 feet, which indeed facilitates handling of the evacuation system 4.

For example, if the size of the storage unit 7 corresponds to the size an ISO 40 feet container, the dimensions of the storage unit 7 will be 12.2×2.44×2.59 (l×w×h), which corresponds to a volume of the storage unit 7 of 77.10 $m^3$.

According to the inventive idea, the volume of the storage unit 7 corresponds to less than 0.2 $m^3$ per person to be evacuated. Advantageously, the volume corresponds to less than 0.15 $m^3$ per person to be evacuated, preferably less than 0.12 $m^3$, most preferably less than 0.10 $m^3$.

The evacuation system 4 shown in FIGS. 3*a* and 3*b* has an evacuation capacity of 800 persons divided between four self-propelling, inflatable floatable units 5. The storage unit 7 is an ISO 40 feet container and has a volume of 77.10 $m^3$. Thus, the volume of the storage unit 7 corresponds to 0.096 $m^3$ per person to be evacuated. It is very surprising that such a high evacuation capacity for self-propelling, floatable units 5 only requires a person volume of less than 0.10 $m^3$ per person to be evacuated.

The storage unit in other, not shown embodiments may have other volumes due to the configuration of the storage unit. However, the volume of the storage unit may be less than 200 $m^3$, preferably less than 100 $m^3$, more preferably less than 80 $m^3$.

Additionally, the evacuation system may have a weight of less than 35,000 kg, preferably less than 25,000 kg.

In another embodiment, the evacuation system may have a maximum height of 2.7 meters. Hereby, it is obtained that the evacuation system may be positioned on one deck only on a vessel, thereby occupying less space on the vessel.

Furthermore, the storage unit may comprise one or more doors or entrances. Additionally, one or more windows may also be arranged in the storage unit.

As shown in FIG. 3*a*, a side 10 of the storage unit 7 facing the water may be openable to enable rapid deployment of the self-propelling, inflatable floatable units out of the storage unit 7. Also, the side 10 of the storage unit 7 may be hinged at the top so that it may be swung upwards when opened, as shown in FIG. 3*a*. Furthermore, in this embodiment, the side 10 may be used as a top protection cover for the interior of the storage unit 7, for the escape units 9 and for the persons being evacuated via the evacuation system 4.

In addition, the storage unit 7 may be hermetically sealed so that an environment inside the storage unit 7 is not influenced by an outside environment. This is especially important since the maritime environment is hard on the evacuation equipment. Moreover, the storage unit 7 may comprise a climate device (not shown) adapted to control the environment inside the storage unit 7. In one embodiment, the climate device may comprise a humidity control device (not shown) adapted to control the humidity inside the storage unit 7.

In another embodiment, the climate device may be adapted to create a slight overpressure inside the storage unit 7 so as to avoid that outside humidity or moist enters the storage unit 7 if the sealing is lost or if a door/window is opened.

Also, the storage unit 7 may comprise a monitoring device (not shown) which is adapted to real time monitor the environment inside the storage unit 7. The monitoring device may have a log part storing measurements of the monitored environment so that the measurements may be accessed for evaluation at any time. Moreover, a display (not shown) may be arranged outside the storage unit 7 to facilitate reading of the measurements of the environment inside the storage unit 7. Further, the monitoring device may have a transmitter which is adapted to send the measurements of the environment to a remotely placed storing device which may be accessed by the ship owner, a service provider or other relevant persons.

The storage unit 7 may also comprise its own power supply which may for instance supply power to the deployment arrangement, the climate device, the monitoring device and other energy-consuming devices.

Figure 4A:
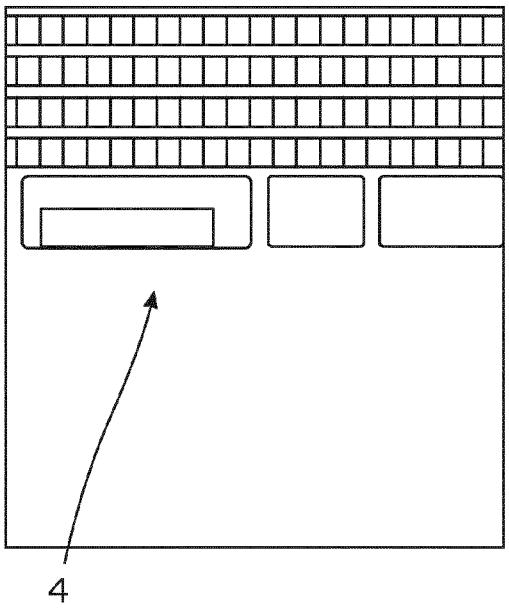
FIGS. 4*a* and 4*b* show two examples of how the evacuation system may be arranged on a vessel.
Figure 4B:
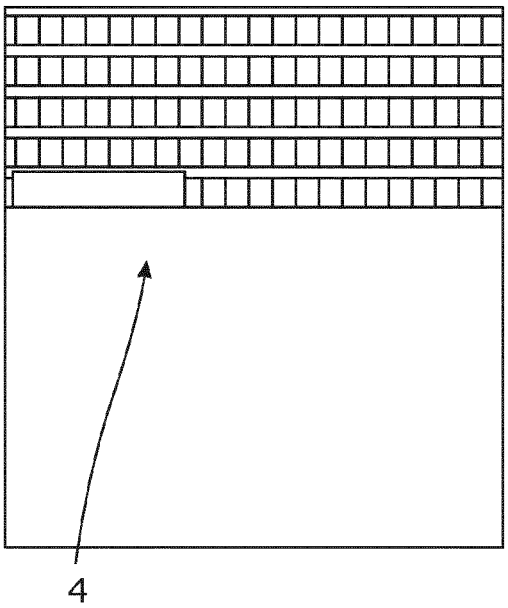

In FIG. 4*a*, the evacuation system 4 is arranged on a deck of the vessel, and in FIG. 4*b*, the evacuation system 4 is built into the vessel. Advantageously, the evacuation system may also be retrofitted on vessels and offshore facilities, thereby replacing existing evacuation systems on the vessels, whereby the ship owners will gain more space and room for other purposes.

Figure 5A:
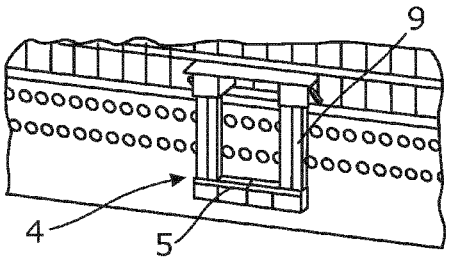
FIGS. 5*a* to 5*f* show sequences of the evacuation system in use.
Figure 5B:
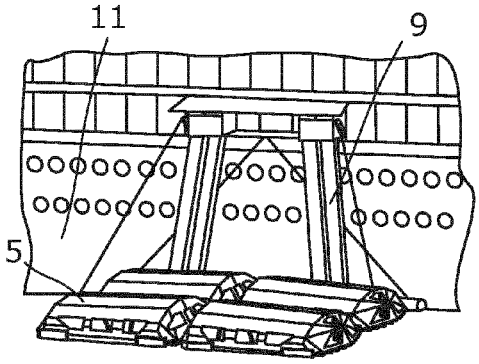

In FIGS. 5*a* to 5*f*, sequences of the use of the evacuation system 4 are shown. In FIG. 5*a*, the deflated self-propelling, inflatable floatable units 5 are being deployed into the water. During the deployment of the deflated self-propelling, inflatable floatable units 5, the escape units 9 are being deployed as well. As soon as the deflated self-propelling, inflatable floatable units 5 are in the water, they inflate and position themselves along the vessel side, as shown in FIG. 5*b*.

Figure 5C:
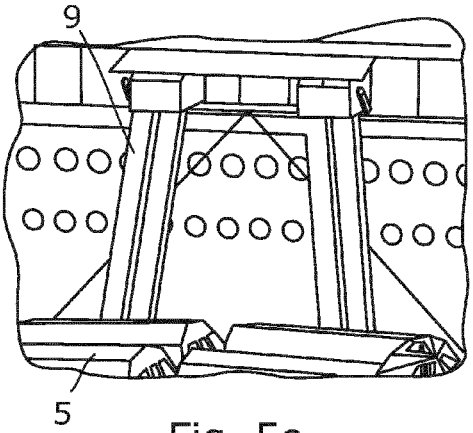
Figure 5D:
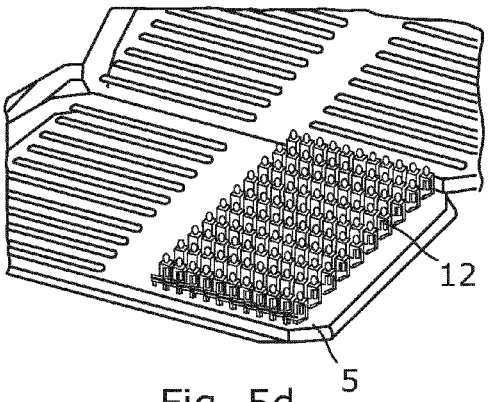
Figure 5E:
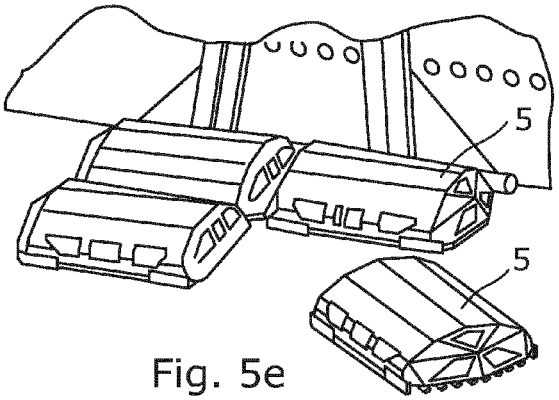
Figure 5F:
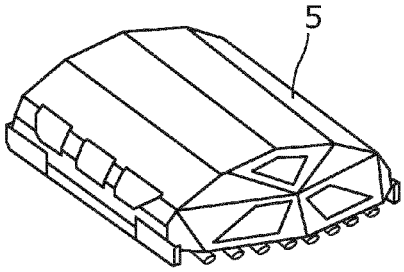

When the self-propelling, inflatable floatable units 5 are fully inflated, the evacuation of persons on board the vessel is performed via the escape units 9, here in the form of vertical chutes, as shown in FIG. 5*c*. In FIG. 5*d*, the canopy of the self-propelling, inflatable floatable units 5 is removed, and the figure shows the seating arrangement as well as how the persons 12 present in the self-propelling, inflatable floatable units 5 are seated. The seating arrangement is inflatable and designed so that the persons to be evacuated occupy less room in the self-propelling, inflatable floatable units 5, resulting in the self-propelling, inflatable floatable units 5 having a high person capacity in relation to the size of the self-propelling, inflatable floatable units 5. As soon as one self-propelling, inflatable floatable unit 5 has reached its maximum capacity, it may release itself from the other self-propelling, inflatable floatable units 5 and sail away from the evacuation by means of its own propulsion means, as shown in FIGS. 5*e* and 5*f*.

In the sequences of FIGS. 6*a* to 6*d*, a deployment arrangement 8 is shown. According to the inventive idea, the compactness of the evacuation system 4 is inter alia obtained by the deployment arrangement 8 having a displacement device 100 and by the displacement device 100 being adapted to displace the one or more self-propelling, inflatable floatable units in a substantially horizontal and linear direction out of the storage unit 7 below the maximum height of 2.7 meters of the storage unit 7 and subsequently lower the one or more self-propelling, inflatable floatable units into the water in a substantially vertical direction.

Figure 6B:
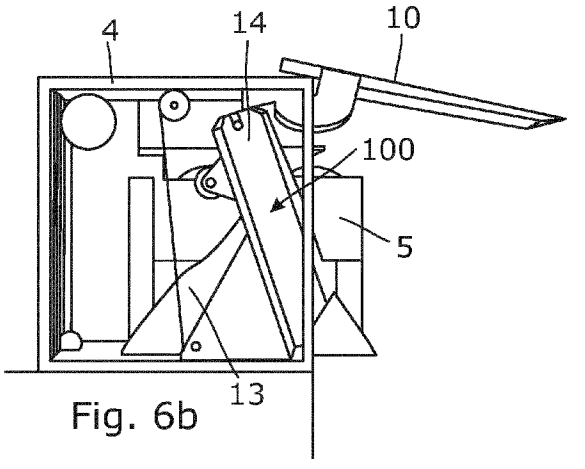
FIGS. 6*a* to 6*d* show sequences of the deployment seen in an end view of the storage unit.
Figure 6A:
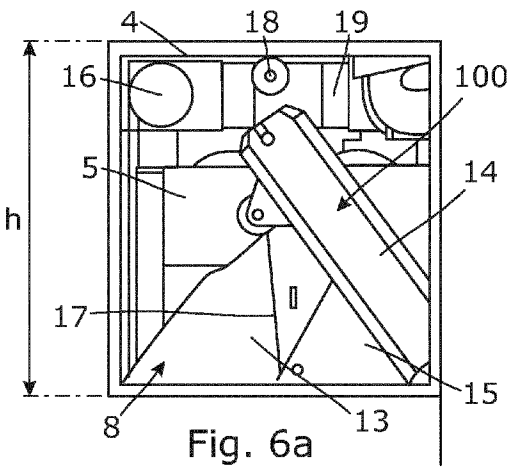
Figure 6D:
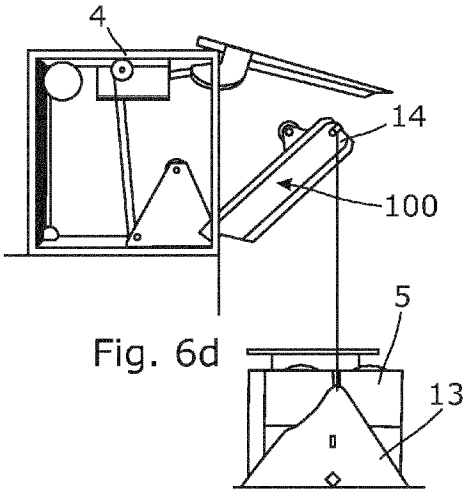
Figure 6C:
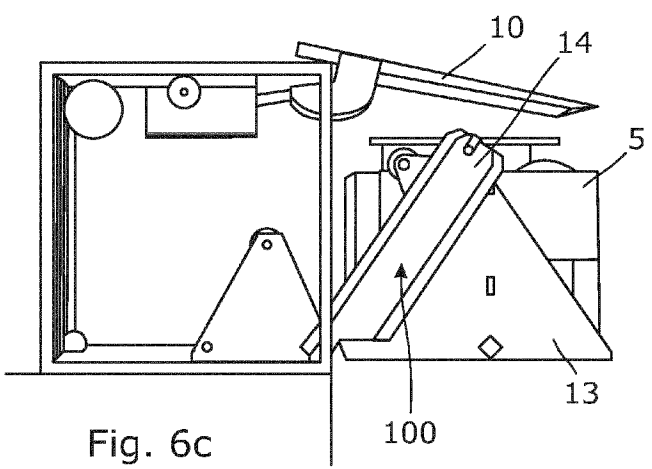

In FIG. 6*a*, the interior of the storage unit 7 is seen from an end of the storage unit 7. As can been seen, the storage unit 7 is fully packed with the various evacuation equipment. The self-propelling, inflatable floatable units 5 is, in this embodiment, positioned on a lifting platform 13 inside the storage unit 7, the lifting platform 13 being adapted to carry the self-propelling, inflatable floatable units 5 during deployment, as shown in FIGS. 6*c* and 6*d*.

The deployment arrangement 8 comprises the displacement device 100 in the form of at least one crane arm 14 pivotally arranged on a crane base 15, a winch 16 connected to a wire 17, a number of pulleys 18 arranged on the crane arm 14 and the crane base 15, and an actuator 19 which is adapted to move the crane arm 14. In FIG. 6*b*, the side 10 of the storage unit 7 has been opened and the lifting platform 13 with the self-propelling, inflatable floatable units 5 is starting to be displaced sideways out, in a substantially horizontal and linear direction of the storage unit 7. In FIG. 6*c*, the lifting platform 13 is positioned outside the storage unit 7 by the displacement device 100 has displaced it out of the storage unit 7 without exceeding the maximum height of the storage unit, and is ready to be lowered by the displacement device 100 in a substantially vertical direction as shown in FIG. 6*d*.

Figures 7A, 7B, 7C, 7D, 7E:
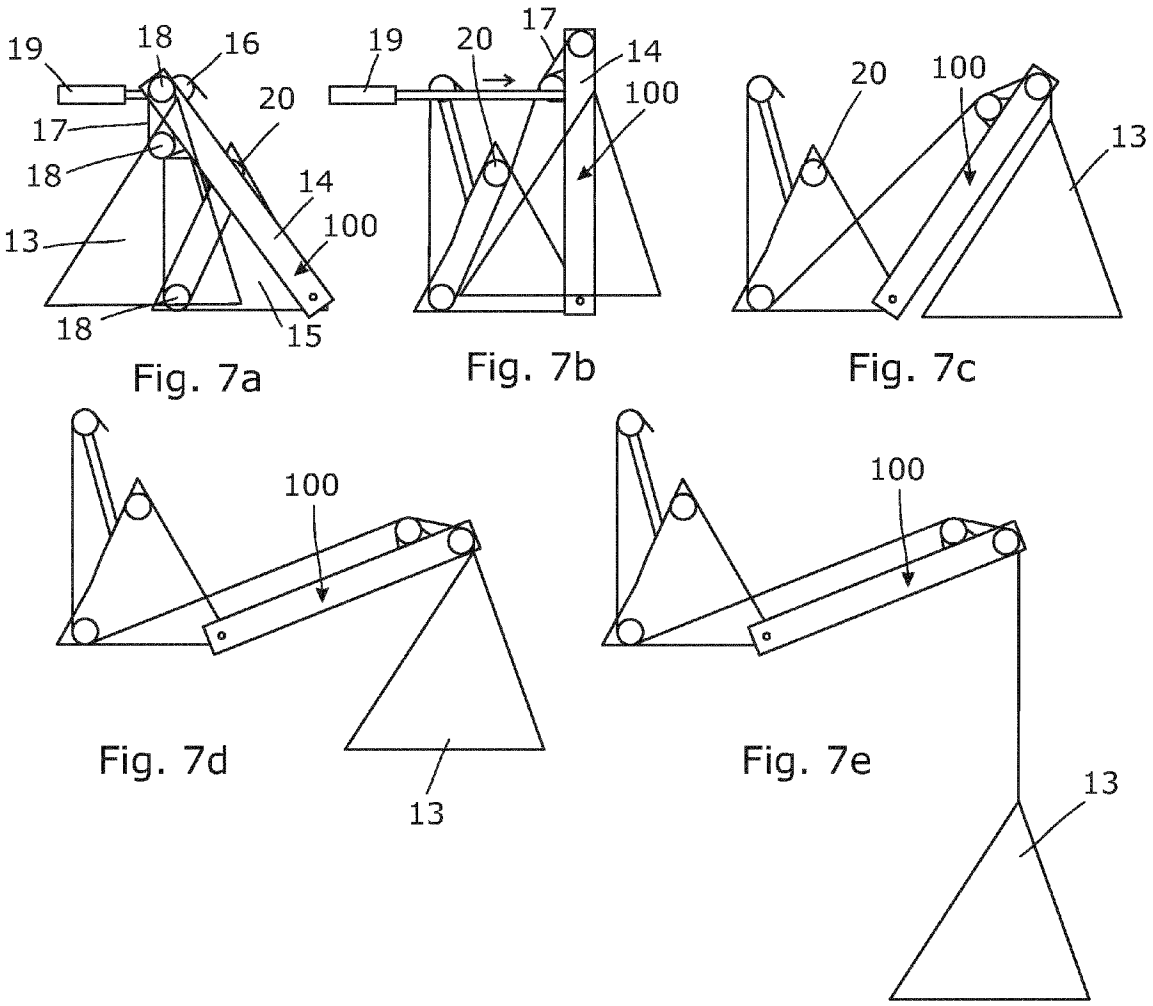
FIGS. 7*a* to 7*e* show schematic sequences of the deployment of FIGS. 6*a* to 6*d*.

In the sequence FIGS. 7*a* to 7*e*, the deployment arrangement 8 and its functionality are shown. In FIG. 7*a*, the deployment arrangement 8 is shown in the storage situation, packed in the storage unit (not shown). As mentioned above, the deployment arrangement 8 comprises the displacement device 100 in the form of a crane arm 14 pivotally arranged on a crane base 15, a winch 16 connected to a wire 17, a number of pulleys 18 arranged on the crane arm 14 and the crane base 15 and an actuator 19 which is adapted to move the crane arm 14.

Furthermore, a guide pulley 20 is arranged on top of the crane base 15. During the deployment procedure, the winch 16 firstly wind the wire 17 a little distance long enough for the lifting platform 13 to be raised from the floor of the storage unit. Hereinafter, the winch 16 is secured. The actuator 19 starts to move the displacement device 100 in the form of a set of crane arms 14, and the lifting platform 13 is displaced horizontally out of the storage unit. By arranging the guide pulley 20 around which the wire 17 is guided, the circular motion of the displacement device 100 in the form of the crane arm 14 is compensated for so that a substantially linear horizontal movement of the lifting platform 13 is obtained instead of the slightly circular lifting curve of the crane arms 24, as shown in FIG. 7*b*. In FIGS. 7*c* to 7*e*, the lifting platform 13 is further displaced in a horizontal direction and subsequently lowered by the displacement device 100.

Figure 8:
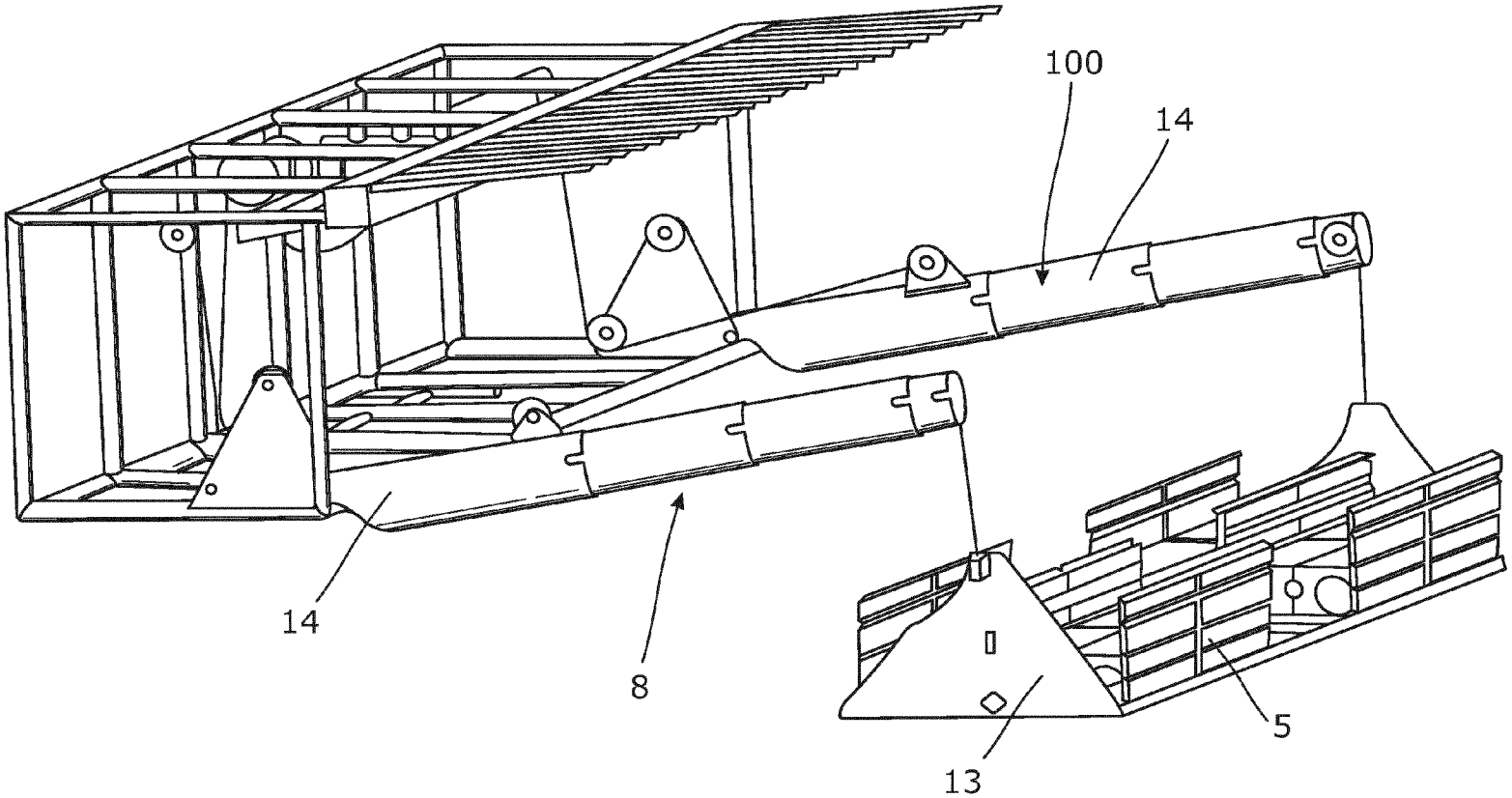
FIG. 8 shows a perspective view of the deployment arrangement in operation.

In FIG. 8, the deployment arrangement 8 is shown in use, deploying the lifting platform 13 supporting the self-propelling, inflatable floatable units 5 (not shown). In this embodiment, the displacement device 100 in the form of the set of crane arms 14 is shown as telescopic arms, which enables the deployment arrangement 8 to have a larger working area.

By the present deployment arrangement, it is obtained that it does not occupy much room and that it may be fully stored in the storage unit, meaning that a compact evacuation system is obtained.

Figure 9A:
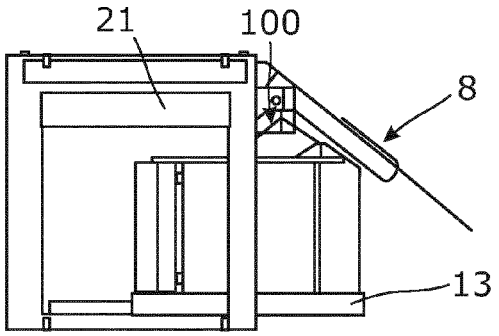
FIGS. 9*a* and 9*b* show other embodiments of a deployment arrangement.
Figure 9B:
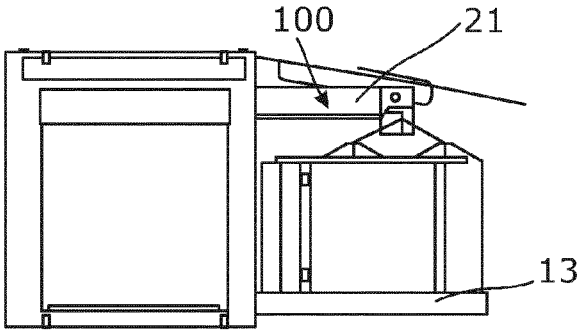

FIGS. 9*a* and 9*b* show another embodiment of the deployment arrangement 8. In this embodiment, the linear displacement of the lifting platform 13 is performed by means of a hydraulic sliding arrangement 21. The hydraulic sliding arrangement 21 comprises the displacement device 100 is adapted to linearly and horizontally displace the lifting platform 13 out of the storage unit. The displacement device 100 of the hydraulic sliding arrangement 21 may comprise at least one sliding arm arranged in the same level as level the lifting platform 13 or above, as shown in FIGS. 9*a*-9*b*.

In another, not shown embodiment, the deployment arrangement may comprise an overhung transverse crane system comprising the displacement device which is adapted to displace the crane system horizontally and linearly out of the storage unit until the lifting platform is free to be lowered into the water. The displacement device of the overhung transverse crane system may comprise at least two telescopic arms arranged above the lifting platform and below the maximum height of the storage unit.

Figure 10:
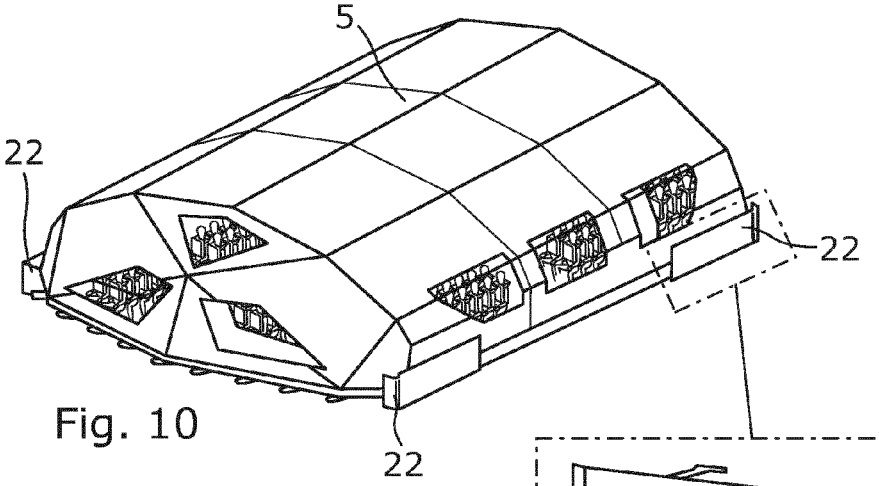
FIG. 10 shows a self-propelling, inflatable floatable unit inflated and filled with evacuated persons.

In FIG. 10, the self-propelling, inflatable floatable unit 5 is shown. The self-propelling, inflatable floatable unit 5 is, in the storage situation, contained in one or more shells. In the shown embodiment, the self-propelling, inflatable floatable unit 5 has four shells 22, one in each corner of the self-propelling, inflatable floatable unit 5, also when it is inflated.

The shells 22 may for instance comprise propulsion means, enabling the inflatable floatable unit 5 to be self-propelling. Advantageously, each shell 22 has a propulsion means facilitating maneuvering of the self-propelling, inflatable floatable unit and providing a redundant propulsion system, enabling the self-propelling, inflatable floatable unit to sail even with one of the propulsion means not functioning.

Figure 11:
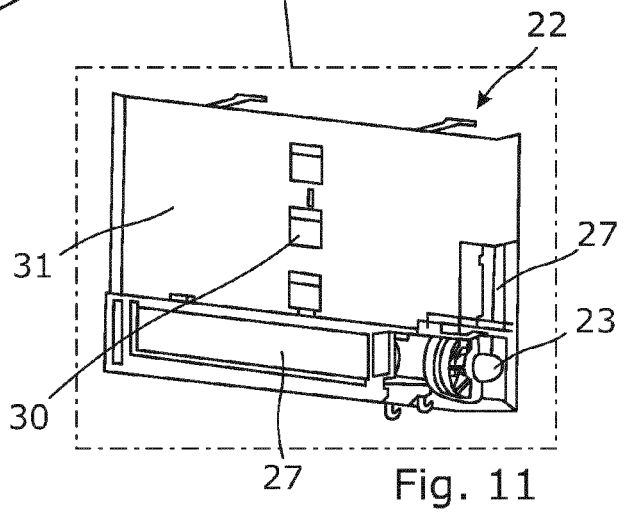
FIG. 11 shows a shell of the self-propelling, inflatable floatable unit.
Figure 12A:
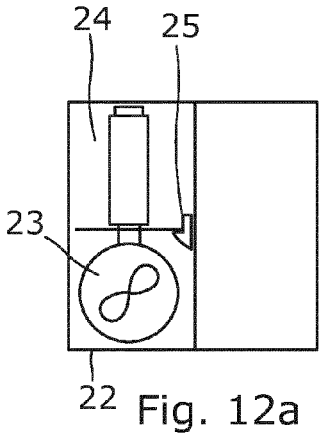
FIGS. 12*a* and 12*b* show schematic views of a compartment of the shell wherein propulsion means is arranged.
Figure 12B:
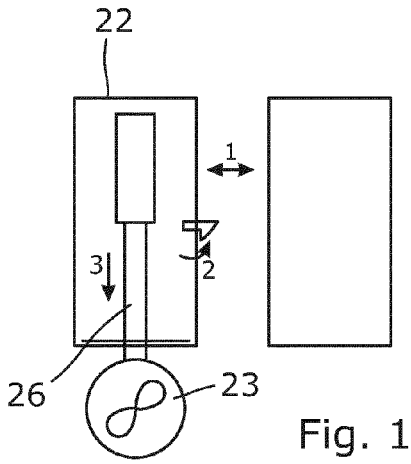

In FIG. 11, a shell 22 is shown in detail, wherein the propulsion means 23 is shown. The shell 22 may comprise a first compartment 24 for the propulsion means 23, in connection with which first compartment 24 a release mechanism 25, cf. FIG. 12*a*, is arranged, which, during the storage situation, secures that the propulsion means 23 is contained in the shell 22, and which enables the propulsion means 23 to be lowered, cf. FIG. 12*b*, so that it extends below the shell 22 when the self-propelling, inflatable floatable unit is inflated. Additionally, the propulsion means 23 may have a vertically extendable screw shaft 26.

In another, not shown embodiment, the propulsion means may be arranged pivotably in the shells so that it may have a first position wherein it is positioned inside the shell and a second position wherein it is pivoted so that it is partly positioned outside the shell.

In one embodiment, the shells may be detachably connected to the self-propelling, inflatable floatable unit. The self-propelling, inflatable floatable unit and the shells may comprise corresponding connection means, the connection means being zips, groove/flange connections, frapping, he/she connections or the like.

Further, one or more of the shells 22 may comprise a second compartment 27 for a power supply, such as a battery pack, as shown in FIG. 11. The second compartment 27 may be watertight to prevent water from entering the second compartment 27 and flooding the power supply. Moreover, the shells 22 may have an outside 31, the side 31 being opposite a side facing the self-propelling, inflatable floatable unit, and a ladder 30 being arranged on the outside 31.

Preferably, the propulsion means are electric motors. Furthermore, during the storage situation, the durability and functionality of the propulsion means has to be checked with predetermined intervals to secure that they will be able to function properly during an evacuation. This check may be performed via an electronic device which is electronically connected with the propulsion means and which is adapted to check whether the propulsion means are connected with a functioning power supply.

Figure 13:
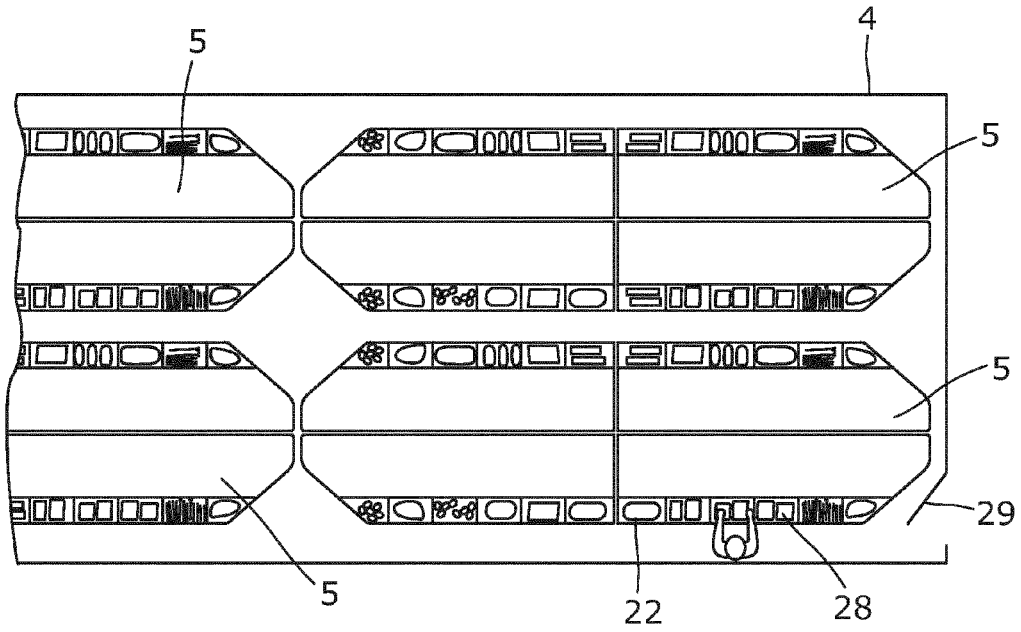
FIG. 13 shows a schematic view of the inside of the storage unit, wherein compartments for dated items in the shells are visible, FIG. 14 schematically shows four self-propelling, inflatable floatable units contained in shells which are mutually attached within the storage unit, FIG. 15 schematically shows the four self-propelling, inflatable floatable units in an inflated condition, still mutually attached except for one which is released from the others.

In one embodiment, the self-propelling, inflatable floatable units 5 may be positioned inside the storage unit 7 so that they are accessible, for instance for physical inspection, testing, and/or exchanging goods placed within the self-propelling, inflatable floatable unit 5, as shown in FIG. 13. For instance, the shells 22 may comprise a third compartment 28 for dated goods and items, such as food and medical aid. In FIG. 13, a service person has gained access to the interior of the storage unit 7 via the door 29 and is checking the dated goods in the third compartment.

Also, one or more of the shells 22 may comprise inflating devices (not shown), such as nitrogen or carbon dioxide containers. Additionally, the inflating devices may be arranged in the second compartment.

Furthermore, one or more of the shells 22 may comprise a secondary inflating device (not shown), the secondary inflating device being a compressor.

The structure of the self-propelling, inflatable floatable unit is inflatable, and since the self-propelling, inflatable floatable unit has a high capacity and thereby a significant size, a huge amount of inflating gas is necessary for inflating and maintaining a pressure in the inflated structure. The structure is inflated by means of known inflating gases, such as nitrogen or carbon dioxide. However, since these inflating gas containers have a high weight, they add to the overall weight of the self-propelling, inflatable floatable unit.

Thus, an air compressor may be arranged for inflating secondary structures of the self-propelling, inflatable floatable unit.

Furthermore, the self-propelling, inflatable floatable unit may lose pressure in the inflated structure over time. Since the self-propelling, inflatable floatable unit may be equipped with small hoses to the valves in the inflated structure, and these hoses may be connected with the compressor which, via continuous measurements of the pressure in the inflated structure, will start when it observes a loss in pressure and thereby provide the required pressure to the inflated structure. Hereby, a constantly stable, reliable and functional self-propelling, inflatable floatable unit is obtained.

Figure 14:
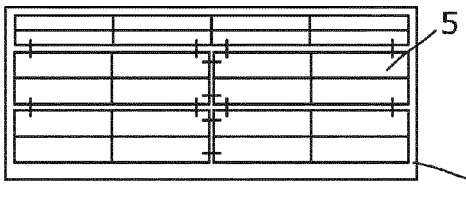

Furthermore, the shown four self-propelling, inflatable floatable units are released in one common system. During inflation, followed by boarding of the persons to be evacuated, it is important that the self-propelling, inflatable floatable units are closely attached. FIG. 14 shows the self-propelling, inflatable floatable units 5 stored in the storage unit 7, releasably attached to each other.

Figure 15:
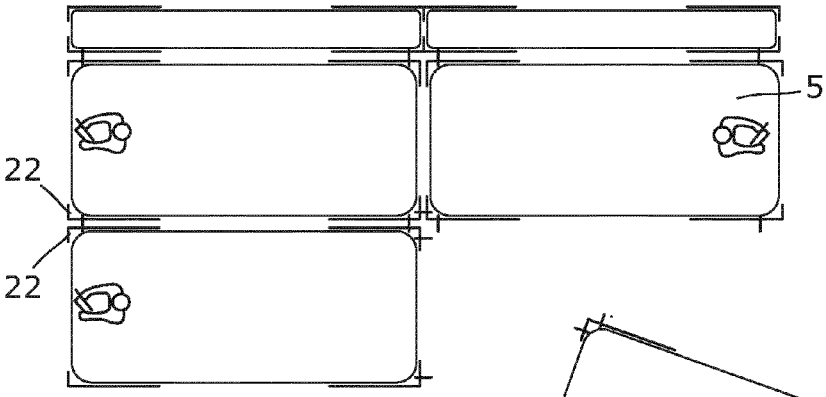

When a self-propelling, inflatable floatable unit has been filled with persons to be evacuated, it must be released from the other units, enabling it to sail away from the other unite, as shown in FIG. 15.

Figure 16A:
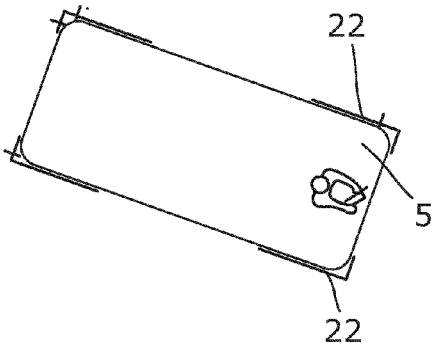
FIGS. 16*a* and 16*b* show a release mechanism, FIGS. 17*a* to 17*d* also show the release mechanism between the shells within a specific self-propelling, inflatable floatable unit, FIGS. 18*a* to 18*d* schematically show top views of sequences of a self-propelling, inflatable floatable unit being inflated, and FIGS. 19*a* to 19*b* schematically show four self-propelling, inflatable floatable units contained in shells and the beginning of an inflation procedure of the four self-propelling, inflatable units.
Figure 16A:
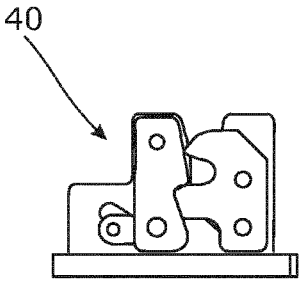
Figure 16B:
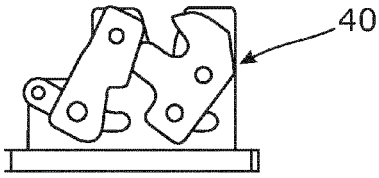

The self-propelling, inflatable floatable units are releasably attached to each other, for instance by means of a release mechanism 40, as shown in FIGS. 16*a* and 16*b*. FIG. 16*a* shows the release mechanism 40 in a locked position, and FIG. 16*b* shows the release mechanism 40 in a released position.

Figures 17A, 17B, 17C, 17D:
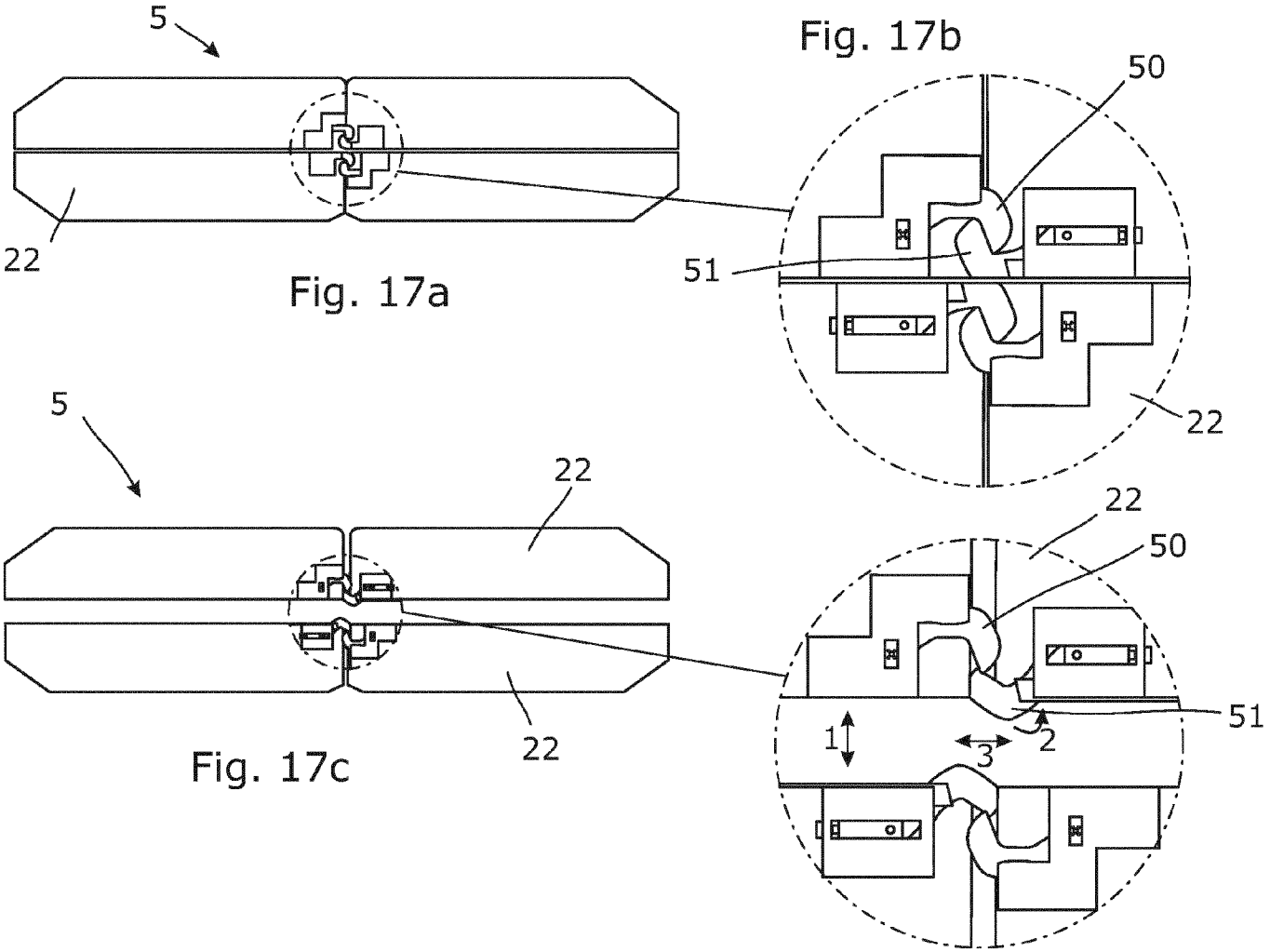

During the storage situation, the self-propelling, inflatable floatable units may be contained in for instance four shells 22. These separate shells 22 may be attached to each other to provide a closed housing for the self-propelling, inflatable floatable units. However, it is important that the shells 22 may easily be released from each other during inflation. The four shells 22 may be attached to each other by means of hooks. One shell is provided with a stationary hook 50, while the other shell is provided with a moveable hook 51. The same applies for the other shells. When the shells 22 are attached, as shown in FIG. 17*a*, they are attached to each other in their length direction by means of plastic fastening means (not shown), and the movable hooks are kept in their locked position. When inflation of the self-propelling, inflatable floatable units begins, the plastic fastening means will burst, and the shells will be separated from each other in their length direction and start moving apart. By this movement, the moveable hooks 51 will become displaced inwardly and out of engagement with the stationary hook 50, causing all the shells to start separating during inflation, as shown in FIGS. 17*c* and 17*d*.

Figure 18A:
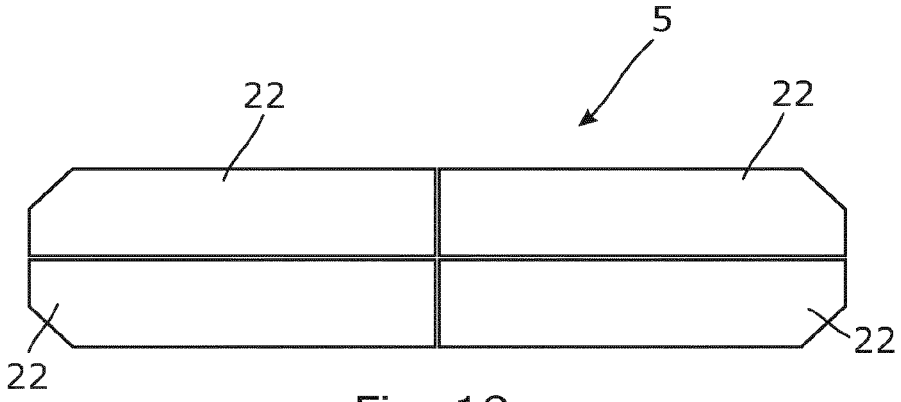
Figure 18B:
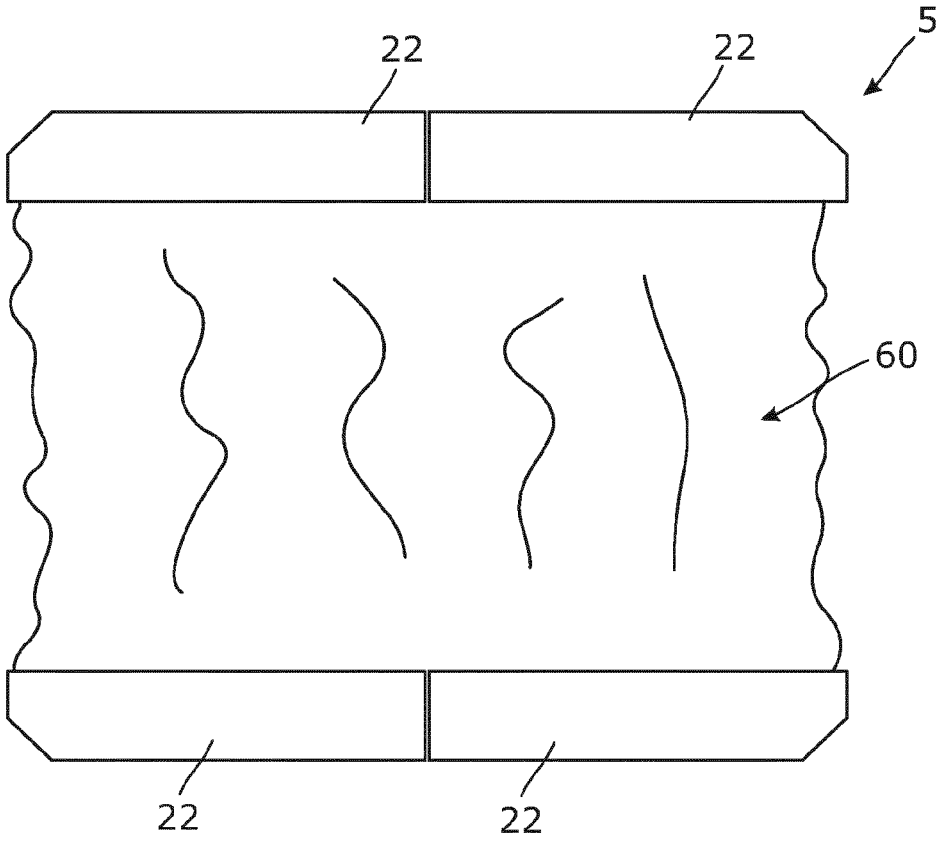
Figure 18C:
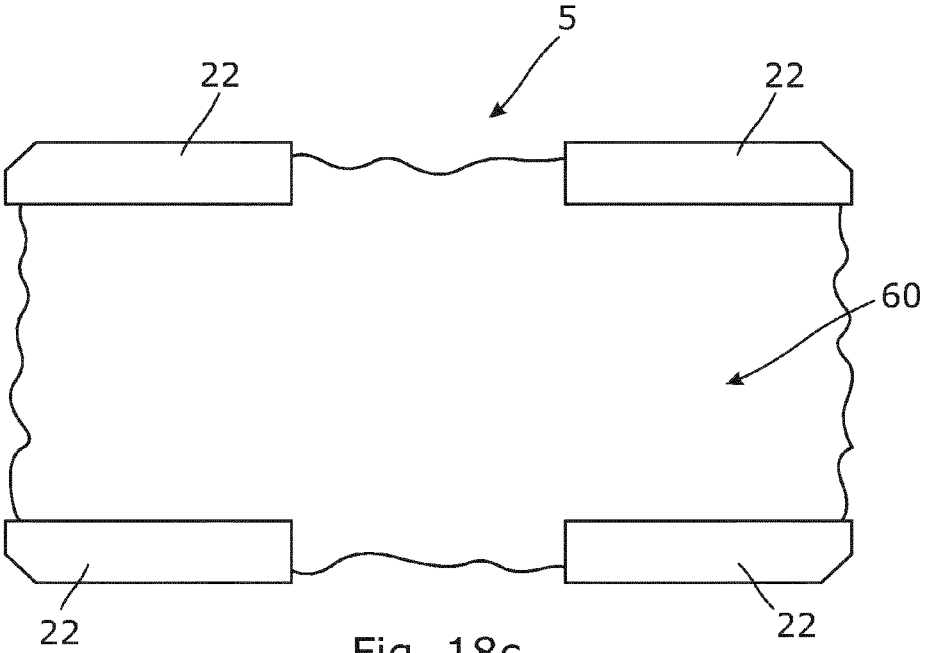
Figure 18D:
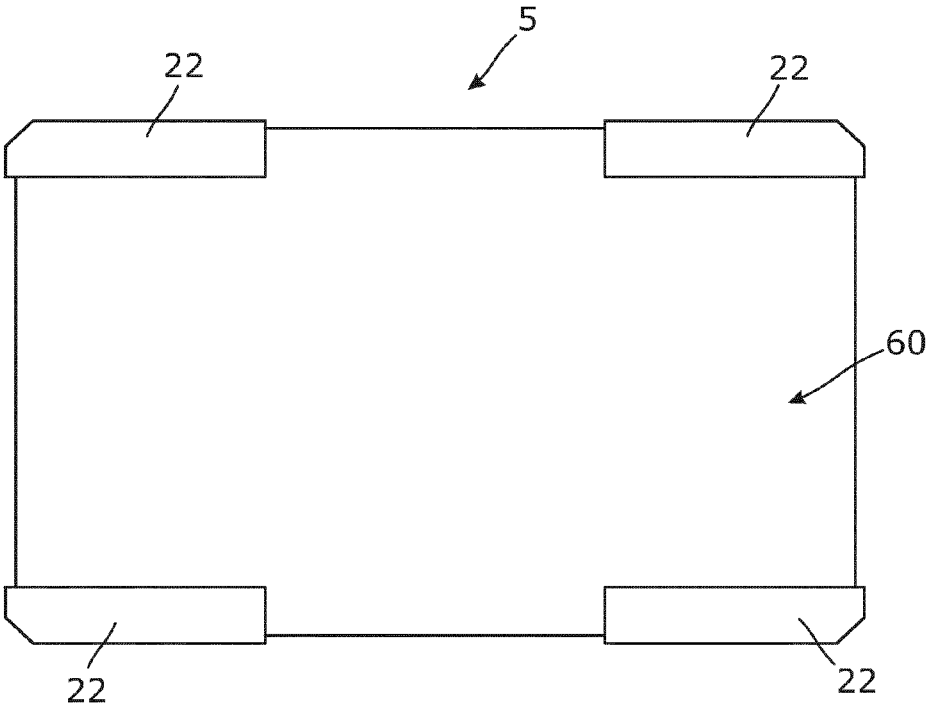

FIGS. 18*a* to 18*d* schematically show top views of sequences of the self-propelling, inflatable floatable unit being inflated. In FIG. 18*a*, the self-propelling, inflatable floatable unit is contained in four shells 22. When the inflating procedure starts, the two sets of shells start to move away from each other because the inflatable structure 60 arranged inside the shells 22 is being inflated and thereby grows in size. Subsequently, the two sets of shells will also start to move away from each other, as shown in FIG. 18*c*, while the inflatable structure 60 still is growing in size due to the inflating. When the inflatable structure 60 of the self-propelling, inflatable floatable unit 5 is substantially fully inflated, the shells 22 are, in this embodiment, positioned in each corner of the unit 5, as shown in FIG. 18*d*.

Figure 19A:
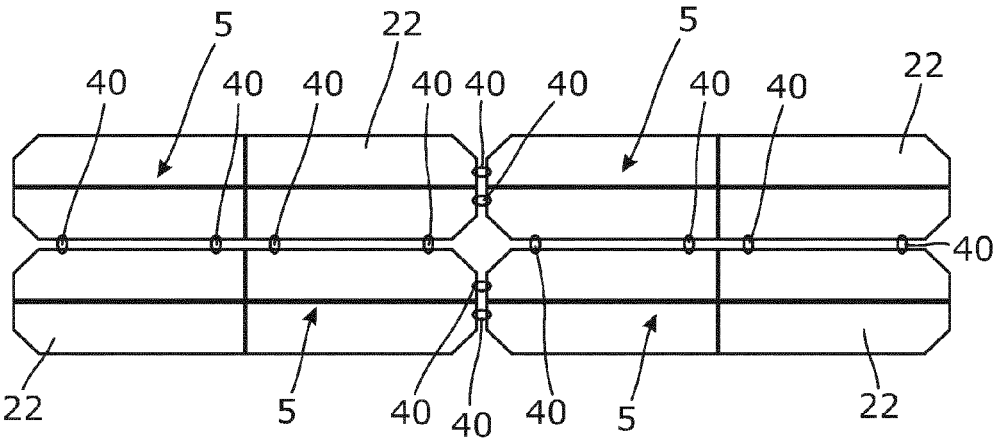
Figure 19B:
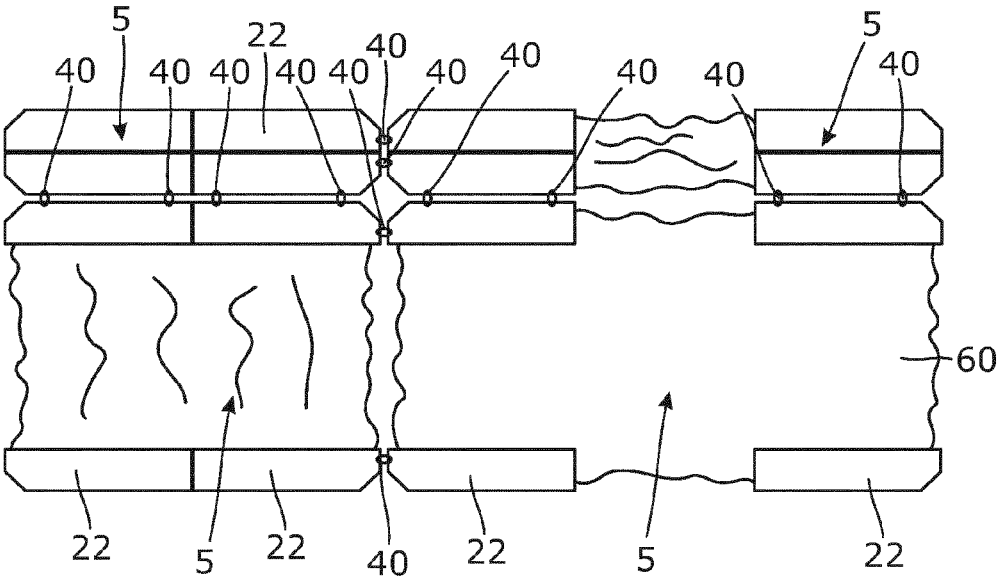

FIGS. 19*a* to 19*b* schematically show four self-propelling, inflatable floatable units 5 contained in shells 22 and the beginning of an inflation procedure of the four self-propelling, inflatable units 5.

In FIG. 19*a*, the four self-propelling, inflatable floatable units 5 are releasably attached to each other via the release mechanisms 40 arranged between the shells 22. In FIG. 19*b*, the inflation procedure of the four self-propelling, inflatable floatable units 5 has been initiated. Since the shells 22 of the self-propelling, inflatable floatable units 5 are attached, the inflation of the inflatable structures 60 provides a specific inflating procedure of the four self-propelling, inflatable floatable units 5, as shown in FIG. 19*b*.

Although the invention has been described in the above in connection with preferred embodiments of the invention, it will be evident for a person skilled in the art that several modifications are conceivable without departing from the invention as defined by the following claims.

The invention claimed is:

1. An evacuation system for a vessel or offshore facility comprising a storage unit having a length, a width and a height defining a volume of the storage unit, the storage unit in a storage situation being adapted to house:

i) one or more self-propelling, inflatable floatable units, the inflatable floatable units each having a capacity of more than 150 persons, and ii) a deployment arrangement having a displacement device, wherein a maximum height of the storage unit is 2.7 meters, and the displacement device is adapted to displace the one or more self-propelling, inflatable floatable units in a substantially horizontal and linear direction out of the storage unit below the maximum height and subsequently lower the one or more self-propelling, inflatable floatable units into the water in a substantially vertical direction, wherein the deployment arrangement comprises an overhung transverse crane system comprising the displacement device, which displacement device is adapted to displace the crane system horizontally and linearly out of the storage unit until a lifting platform is free to be lowered into the water, and wherein the displacement device comprises at least two telescopic arms arranged above the lifting platform and below the maximum height of the storage unit.

2. The evacuation system according to claim 1, wherein the self-propelling, inflatable floatable unit is positioned on the lifting platform inside the storage unit, the lifting platform being adapted to carry the self-propelling, inflatable floatable unit during deployment.

3. The evacuation system according to claim 1, wherein the storage unit houses one or more escape units.

4. The evacuation system according to claim 1, wherein the volume of the storage unit corresponds to less than 0.2 $m^3$ per person to be evacuated.

5. The evacuation system according to claim 4, wherein the volume corresponds to less than 0.15 $m^3$ per person to be evacuated.

6. The evacuation system according to claim 4, wherein the volume of the storage unit is less than 200 $m^3$.

7. The evacuation system according to claim 1, wherein the storage unit has a length of 12.2 m, a width of 2.44 m and a height of 2.59 m, corresponding to a 40 feet ISO container.

8. The evacuation system according to claim 1, wherein the storage unit has the same size as an ordinary ISO container of 40 feet, 45 feet or 20 feet.

9. The evacuation system according to claim 1, wherein the self-propelling, inflatable floatable unit has a capacity of at least 200 persons.

10. The evacuation system according to claim 1, wherein the evacuation system has a weight of less than 30,000 kg.

11. The evacuation system according to claim 1, wherein the storage unit comprises one or more doors and/or closable openings.

12. The evacuation system according to claim 11, wherein a side of the storage unit facing the water is openable to allow rapid deployment of the self-propelling, inflatable floatable units.

13. The evacuation system according to claim 1, wherein the storage unit is hermetically sealed so that an environment inside the storage unit is not influenced by an outside environment.

14. The evacuation system according to claim 1, wherein the storage unit comprises a climate device adapted to control the environment inside the storage unit.

15. The evacuation system according to claim 14, wherein the climate device comprises a humidity control device adapted to control the humidity inside the storage unit.

16. The evacuation system according to claim 13, wherein the climate device is adapted to create a slight overpressure inside the storage unit so as to avoid that outside humidity or moist enters the storage unit if the sealing is lost or if a door is opened.

17. The evacuation system according to claim 13, wherein the storage unit comprises a monitoring device which is adapted to real time monitor the environment inside the storage unit.

18. The evacuation system according to claim 17, wherein the monitoring device has a log part storing measurements of the monitored environment so that the measurements may be accessed for evaluation at any time.

19. The evacuation system according to claim 18, wherein a display is arranged outside the storage unit to facilitate reading of the measurements of the environment inside the storage unit.

20. The evacuation system according to claim 19, wherein the monitoring device has a transmitter adapted to send the measurements of the environments to a remotely placed storing device.

21. The evacuation system according to claim 1, wherein the self-propelling, inflatable unit is contained in one or more shells when stored in the storage unit.

22. The evacuation system according to claim 1, wherein the self-propelling, inflatable units are positioned inside the storage unit so that they are accessible, for instance for physical inspection, testing and/or exchanging goods placed within the self-propelling, inflatable floatable unit.

23. The evacuation system according to claim 21, wherein a plurality of self-propelling, inflatable floatable units having shells are stored in the storage unit, the shells of each self-propelling, inflatable floatable unit being releasably attached to each other so that during the inflation of the self-propelling, inflatable floatable units they can still be attached to each other to provide a group of self-propelling, inflatable floatable units.

24. The evacuation system according to claim 21, wherein the one or more shells are part of the self-propelling, inflatable floatable unit when inflated.

25. The evacuation system according to claim 24, wherein the self-propelling, inflatable floatable unit comprises four shells, each shell being arranged in a corner portion of the self-propelling, inflatable floatable unit.

26. The evacuation system according to claim 21, wherein one or more of the shells comprise a propulsion device.

27. The evacuation system according to claim 26, wherein the shell comprises a first compartment for the propulsion device, in connection with which first compartment a release mechanism is arranged, which during the storage situation secures that the propulsion device is contained in the shell, and which enables the propulsion device to be lowered so that it extends below the shell when the self-propelling, inflatable floatable unit is inflated.

28. The evacuation system according to claim 26, wherein the propulsion device has a vertically extendable screw shaft.

29. The evacuation system according to claim 27, wherein one or more of the shells comprise a second compartment for a power supply, such as a battery pack.

30. The evacuation system according to claim 29, wherein the second compartment is watertight to prevent water from entering the second compartment and flooding the power supply.

31. The evacuation system according to claim 26, wherein one or more of the shells comprise a third compartment for dated goods and items, such as food, medical aid and/or radio.

32. The evacuation system according to claim 21, wherein one or more of the shells comprise inflating devices.

33. The evacuation system according to claim 21, wherein a plurality of shells surrounds the self-propelling, inflatable floatable unit in the storage situation, the shells being releasably attached to each other.

34. The evacuation system according to claim 33, wherein the shells are releasably attached by means of a releasable mechanical lock.

35. The evacuation system according to claim 21, wherein the shells have an outside being opposite a side facing the self-propelling, inflatable floatable unit, and a ladder being arranged on the outside.

36. The evacuation system according to claim 21, wherein the shells are detachably connected to the self-propelling, inflatable floatable unit.

37. The evacuation system according to claim 36, wherein the self-propelling, inflatable floatable unit and the shells comprise corresponding connectors.

38. The evacuation system according to claim 1, wherein a plurality of self-propelling, inflatable floatable units having shells are stored in the storage unit, the shells of each self-propelling, inflatable floatable unit being releasably attached to each other so that during the inflation of the self-propelling, inflatable floatable units, they can still be attached to each other to provide a group of self-propelling, inflatable floatable unit.

39. The evacuation system according to claim 1, wherein the evacuation system is coupled to a vessel.

40. The evacuation system according to claim 1, wherein the evacuation system is coupled to an offshore facility.

41. The evacuation system according to claim 5, wherein the volume corresponds to less than 0.12 $m^3$.

42. The evacuation system according to claim 5, wherein the volume corresponds to less than 0.10 $m^3$.

43. The evacuation system according to claim 6, wherein the volume of the storage unit is less than 100 $m^3$.

44. The evacuation system according to claim 6, wherein the volume of the storage unit is less than 80 $m^3$.

45. The evacuation system according to claim 10, wherein the evacuation system has a weight of less than 25,000 kg.

46. The evacuation system according to claim 32, wherein the inflating devices include nitrogen or carbon dioxide containers.

47. The evacuation system according to claim 37, wherein the connectors may be selected from the group consisting of zips, groove/flange connections, frapping, and he/she connections.

* * * * *

UNITED STATES PATENT AND TRADEMARK OFFICE

CERTIFICATE OF CORRECTION

PATENT NO. : 9,272,757 B2
APPLICATION NO. : 14/127132
DATED : March 1, 2016
INVENTOR(S) : Christian Ibsen et al.

It is certified that error appears in the above-identified patent and that said Letters Patent is hereby corrected as shown below:

In the Specification:

Column 3, line 59, change “moist” to --moisture--.

Column 8, line 56, change “moist” to --moisture--.

Column 9, line 53, change “is” to --are--.

Column 10, line 2, before “has” insert --which--.

Column 10, line 19, change “firstly wind” to --first winds--.

Column 10, line 47, change “comprises” to --comprising--.

Column 10, line 51, after “same level as”, delete “level”.

Column 12, line 29, change “unite” to --units--.

In the Claims:

Column 14, claim 16, line number 29, change “moist” to --moisture--.

Column 15, claim 26, line number 4, change “comprise” to --comprises--.

Column 15, claim 29, line number 16, change “comprise” to --comprises--.

Column 15, claim 31, line number 23, change “comprise” to --comprises--.

Column 16, claim 38, line number 14, change “unit” to --units--.

Signed and Sealed this
Twenty-sixth Day of July, 2016

Michelle K. Lee

Michelle K. Lee
*Director of the United States Patent and Trademark Office*